US005361851A

United States Patent [19]

Fox

[11] Patent Number: 5,361,851

[45] Date of Patent: Nov. 8, 1994

[54] TOOL REACH EXTENDER

[75] Inventor: Morton H. Fox, Covina, Calif.

[73] Assignee: Marilyn S. Fox, Covina, Calif.

[21] Appl. No.: 21,168

[22] Filed: Feb. 22, 1993

[51] Int. Cl.[5] ..... B27C 3/08; B25F 5/02

[52] U.S. Cl. ..... 173/170; 408/712; 30/296.1

[58] Field of Search ..... 173/170, 171, 36, 31, 173/32, 34; 408/712, 99, 100, 110, 112, 136; 30/296.1

[56] References Cited

U.S. PATENT DOCUMENTS

| | | | |
|---|---|---|---|
| 2,405,110 | 8/1946 | Bullock | 173/36 |
| 2,989,334 | 6/1961 | Browne . | |
| 2,997,900 | 8/1961 | Pugsley | 408/712 |
| 3,060,769 | 10/1962 | Heider | 408/712 |
| 3,552,239 | 1/1971 | Yeaman et al. | 408/136 |
| 3,949,817 | 4/1976 | Rice | 30/296.1 |
| 3,985,188 | 10/1976 | Steele . | |
| 4,145,810 | 3/1979 | Belliston | 30/296.1 |
| 4,147,220 | 4/1979 | Swiderski, Jr. et al. . | |
| 4,153,193 | 5/1979 | Urbanowicz . | |
| 4,179,805 | 12/1979 | Yamada | 30/296.1 |
| 4,262,822 | 4/1981 | Corte . | |
| 4,349,301 | 9/1982 | Boyajian | 408/712 |
| 4,374,600 | 2/1983 | van Zelm . | |
| 4,736,804 | 4/1988 | Geibel | 173/30 |
| 4,996,773 | 3/1991 | Albertson | 30/296.1 |

*Primary Examiner*—Scott Smith

*Attorney, Agent, or Firm*—Boniard I. Brown

[57] ABSTRACT

A tool reach extender is usable with a variety of different hand tools, and has grip handle portion fitting into a saddle member slidably adjustable on a guide structure at one end of the reach extender. The guide structure front end is connected to a cradle which has a clamp screw engageable against the undersurface of a tool body. The cradle has a U-shaped bridging bar to overlie the upper surface of the tool body so that the nose portion of the tool is clamped in the cradle. The saddle member and cradle cooperatively grip and support the tool. Various tool sizes are accommodated.

15 Claims, 2 Drawing Sheets

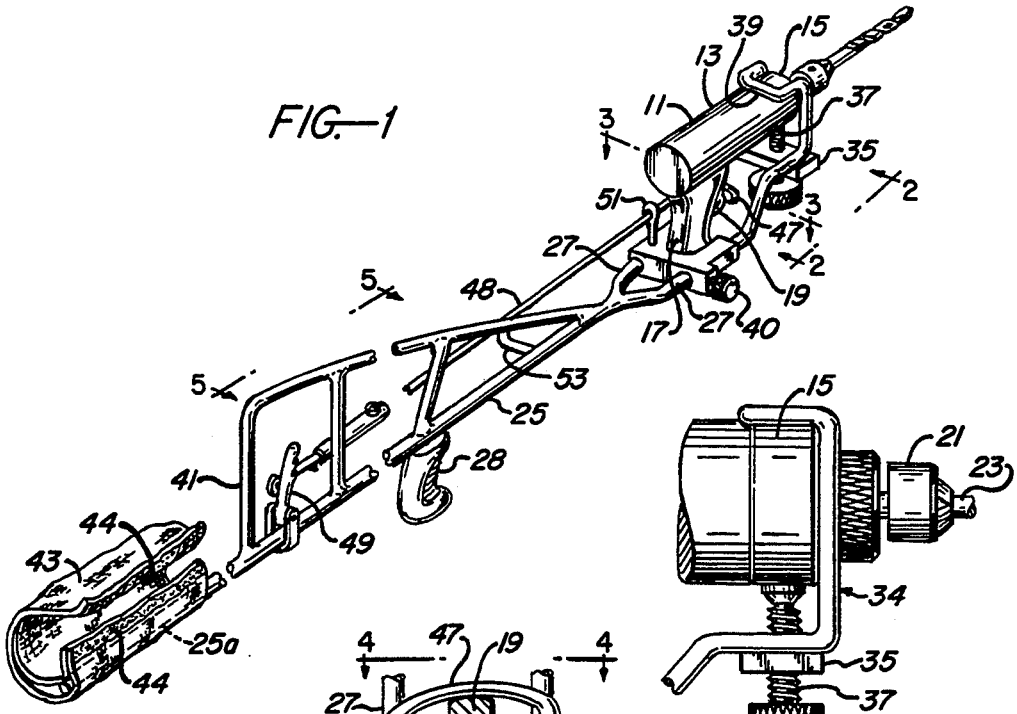
FIG.—1
FIG.—2
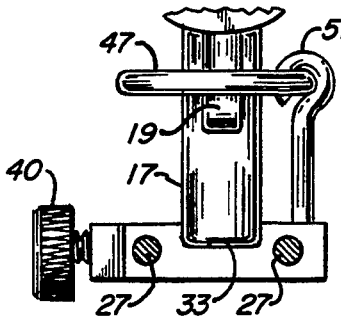
FIG.—4
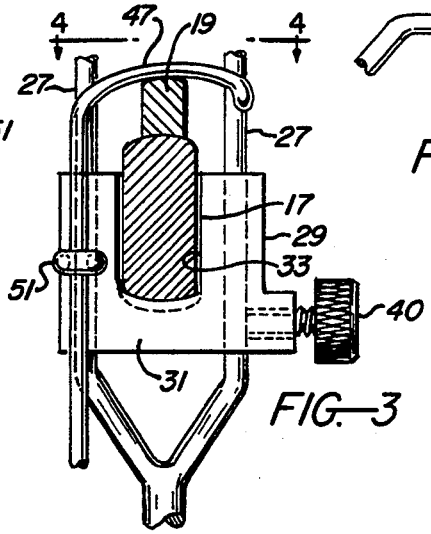
FIG.—3
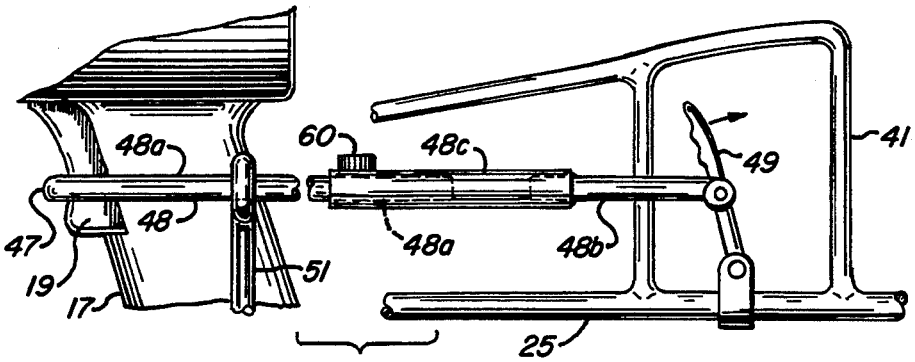
FIG.—5

TOOL REACH EXTENDER

BACKGROUND OF THE INVENTION

1. Field of the Invention:

The present invention relates to a device for extending the reach of a person operating a hand-tool. The device is particularly adapted for use with caulking guns, gluing guns, power drills, explosive-actuated rivet and fastener insertion tools.

2. Prior Developments:

Persons whose jobs include using portable hand-operated tools are sometimes required to use these tools at arms length because of difficulties in getting closer to a workpiece. Often, the work piece may be beyond the persons reach. The operator then has several choices, including skipping the operation which is out of reach, assuming an unnaturally distorted or risky body position (risking personal injury) or fabricating or otherwise providing some means to get closer to the workpiece. These situations result either in lowered quality of workmanship, unnecessary stress and/or possible injury to the operator, or lost time and additional work until means are provided to reach the objective with the required tool.

As an example, caulking, sealing or gluing often make use of an apparatus known as a caulking gun. A tube of either caulking compound, other sealant or adhesive is loaded into the caulking gun, positioned by the operator, and the contents of the tube ejected as a trigger is squeezed to cause a plunger to be advanced into the back of the tube to eject the tube's contents. This apparatus functions well as long as the object to which the tube's contents are to be applied is within the operator's reach while holding the gun.

However, the ejection nozzle must be positioned in near proximity to the work surface. When the operator is too far from the work surface, the caulking gun cannot be operated in the desired manner. Similar problems exist with respect to other tools, such as gluing guns, power drills, and rivet and faster insertion tools.

Reach extender devices usable with various tools have been proposed. U.S. Pat. No. 3,985,188 to Steele shows a reach extender device usable with an explosive-actuated riveter tool, comprising a hollow pole having L-shaped support means on one end. A U-shaped yoke extends from the L-shaped support means to support a cradle that partially surrounds the barrel of a riveter tool. A bight portion of the yoke engages the trigger of the tool. A spring-biased plunger is mounted on the base of the L-shaped support, so that an upward manual pressure on the lower end of the pole compresses the spring for actuation of the tool.

U.S. Pat. No. 4,147,220 to Swiderski, et al., discloses a reach extender device that includes an elongated pole having a tool support block on its upper end. A power actuated tool is secured to the tool by a clamp screw extending axially into the tool body. A flexible actuator rope or cable has a loop end portion extending about the tool trigger, whereby a pulling motion on the cable operates the trigger.

Pat. No. 4,262,822, issued to Vincent Corte on Apr. 21, 1981, shows a reach extender device for a caulking gun, comprising an elongated tubular member having an end portion cut away to form a seating surface for the caulking gun. Screws extend through the seating portion of the tubular member into threaded holes in the caulking gun barrel for securement of the gun to the tubular member. The caulking gun trigger is attached to a flexible cable extending along the tubular member to a second trigger, whereby the trigger of the caulking gun can be remotely actuated. The reach extender device requires that special threaded holes be provided in the barrel of the caulking gun to operatively attach the device to the gun.

U.S. Pat. No. 4,153,193 to Urbanowicz shows a pole extender device having a hollow saddle member at one end of a pole to seat against the shoulder portion of a power-actuated tool. The tool is retained on the saddle member by means of a set screw. The saddle member has a guide bore therein for a plunger that carries a trigger-actuator bar. A cable extends from the plunger within the pole to a rotary actuator at the remote end of the pole. The rotary actuator can be turned about the pole axis to remotely operate the tool trigger.

U.S. Pat. No. 2,989,334 to Browne shows a device for remotely grasping and lifting a can or bottle. The device comprises an arm rest extending +from an actuator handle to underlie the forearm of a person. A circular ring element is adapted to encircle the person's arm to partially support the weight of the can or bottle at the other end of the device.

Most prior art devices are intended for use with a specific type of tool, e.g., a caulking gun or a power drill or a riveting tool, and are not designed for interchangeable use with different types of tools or differently sized tools, e.g., a caulking gun and a power drill.

The present invention contemplates a reach extender device usable with different types of tools and differently sized tools, e.g., a relatively short power drill or a relatively long caulking gun.

Another shortcoming of the prior art devices is that they have often required specially modified tools or special tool configurations to operatively attach the extender device to the tool. The reach extender device of the present invention is attachable to a range of different tools without modification of the tool or special tool body configuration. The device of the invention is designed to fit a variety of differently sized tools, e.g., caulking guns, explosive-actuated and power drills.

SUMMARY OF THE INVENTION

A specific embodiment of the invention comprises an elongated arm structure adapted to bridge the space between a person and a tool to be remotely actuated by the person. Typically, the arm structure may have a length of two or three feet. At one end of the arm structure are attached two linear guide rods for slidably supporting a saddle member having a socket surface engageable with the butt end of a pistol grip handle on the tool to be remotely actuated. The forward ends of the linear guide rods are connected to cradle means engageable with the nose end of the tool body so that the saddle member and cradle means jointly support the tool body. The saddle member may be slidably adjusted along the linear guide rods to accommodate different tool body lengths, e.g., a relatively short power drill or a longer caulking gun.

The cradle means has a clamping screw mechanism operable releasably to clamp the cradle means to tool noses having a range of different diameters, whereby the device is adapted to fit a variety of differently dimensioned tool nose structures.

The reach extender device is usable to remotely operate various tools equipped with pistol grip handles and triggers forward of the handle. Actuation of the trigger is accomplished by means of an elongated actuator rod extending along the aforementioned arm structure. One end of the actuator rod has a hook extending partially about the trigger. The other end of the actuator rod is attached to a manual grip element located in near proximity to a handle formed on the end of the elongated arm remote from the supported tool. The person can remotely operate the tool trigger by exerting squeezing force on the handle and associated grip element.

The elongated actuator rod preferably comprises two rod sections adjustably connected together, whereby the total length of the rod may be varied in accordance with variations in the location of the tool trigger relative to the manual grip element.

BRIEF DESCRIPTION OF THE DRAWINGS

FIG. 1 is a perspective view of a reach extender device of the invention with a power drill supported therein;

FIG. 3 is a fragmentary view on line 3—3 in FIG. 1;

FIG. 4 is a fragmentary view taken on line 4—4 in FIG. 3;

FIG. 5 is a fragmentary side elevational view of the device of FIG. 1;

FIG. 9 is a fragmentary side elevational view of the assembly of FIG. 1.

DESCRIPTION OF A PREFERRED EMBODIMENT OF THE INVENTION

Figure 9:
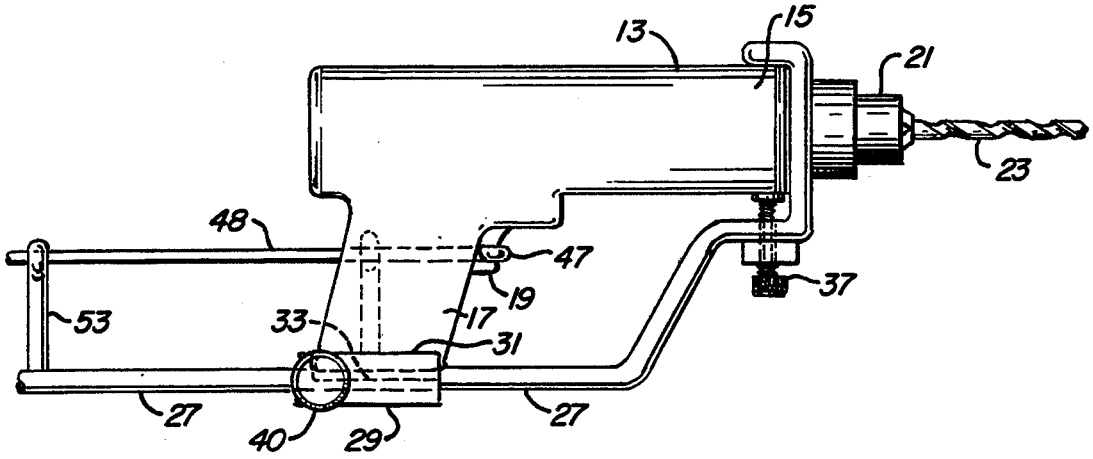
FIG. 9 is a fragmentary view taken on line 2—2 in FIG. 1.

Referring to FIG. 1, there is shown a tool reach extender 10 for a tool 11, which said tool is a power drill having a tool body 13 including a front nose 15 and a pistol grip handle 17. A trigger 19 projects forwardly from the handle. As indicated in FIGS. 2 and 9, the drill has a chuck structure 21 adapted to grip a drill bit 23.

Tool reach extender 10 comprises an elongated arm structure 25 which connects to a linear guide structure defined by two parallel guide rods 27, and which has mounted therein a support grip handle 28. Each guide rod is of circular cross-section, whereby the rods can extend through circular guide holes formed in a saddle member 29. The upper surface 31 of the saddle member is recessed to define a depressed socket surface 33 matched to the surface configuration of the butt end of the pistol grip handle on tool 11. As best shown in FIG. 9, the butt end of the pistol grip handle fits into the socket so that the tool cannot move in a rearward direction relative to the saddle member.

The forward portions of guide rods 27 are connected to cradle means 34. Rods 27 are inclined upwardly and then extend horizontally to form a platform for a flat rectangular nut 35 that spans the two rods. The nut is welded to guide rods 27 to threadably support a clamp screw 37 adapted to engage the undersurface of the tool body. Two parallel upstanding abutment bars 38 extend upwardly from the front ends of guide rods 27 for abutting engagement with the front surface of the tool body nose 15. Bars or abutment bars 38 are spaced far enough apart to have a desired clearance relative to chuck 21.

The upper ends of abutment bars 38 are connected by a U-shaped bridge bar 39 (FIG. 1). As seen in FIG. 2, bar 39 overlies the upper surface of the tool body so that when screw 37 is turned in the clamp direction, the nose portion of the tool is clamped between the bridge bar 39 and the clamp screw. The stroke of the clamp screw is such that tool bodies having a range of different diameter nose portions can be effectively held by the defined cradle means.

Guide rods 27, abutment bars 38, and bridging bar 39 are preferably formed integrally from a single elongated rod which is bent at spaced points therealong to form the rod-like components 27, 38 and 39. The rear ends of rods 27 may be welded to the front end of arm structure 25 after the saddle member 29 has been installed on the linear guide rods.

Figure 6:
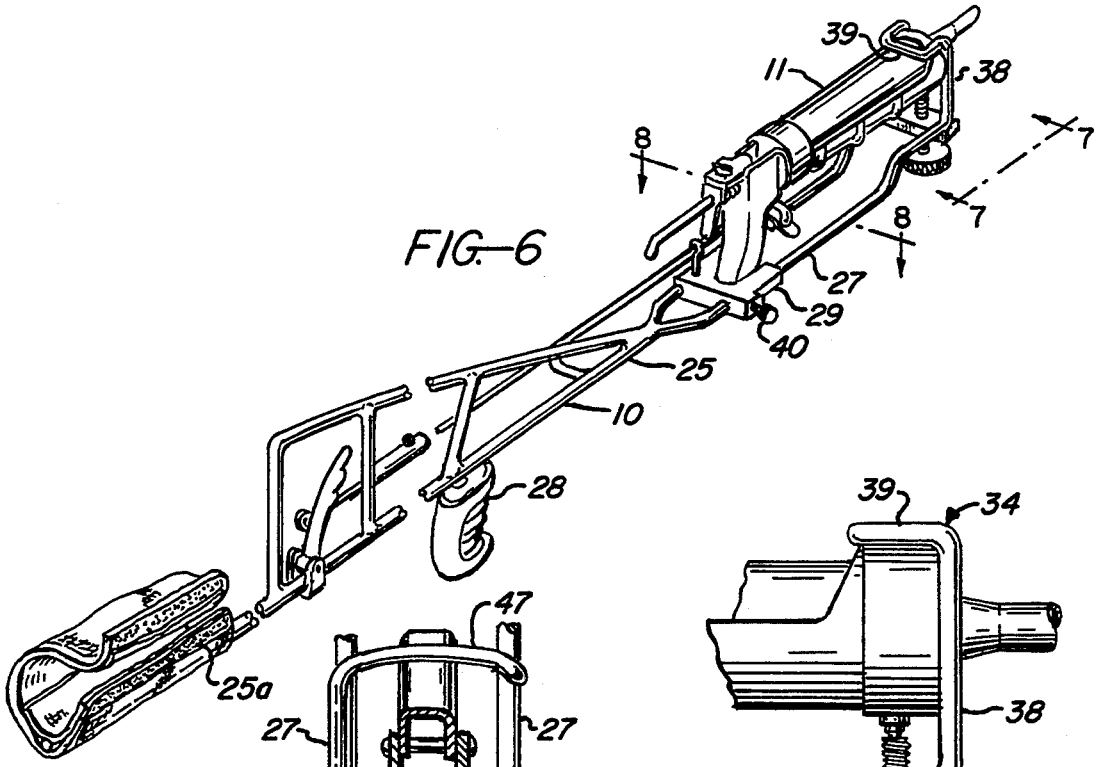
FIG. 6 is a perspective view taken in the same direction as in FIG. 1, showing a caulking gun supported on the reach extender device.

Saddle member 29 and cradle means 34 cooperatively support the tool 11 without drilling any holes in the tool body or otherwise modifying the tool body. Various different types of tools may be supported. FIG. 1 shows the tool reach extender supporting a power drill. FIG. 6 shows the same tool reach extender supporting a caulking gun. Differently sized tools will require slidable adjustment of the saddle member to different locations on the linear guide structure (guide rods 27). An adjustment length of at least six inches is preferred. A set screw 40 extends through a threaded opening in the saddle member to grip one of the guide rods, whereby the saddle member can be locked in selected positions of adjustment.

The left end portion of arm structure 25 comprises an upstanding bar that forms a handle bar 41. Additional bars may be provided to form a vertical reinforcement grid to provide desired rigidity without being unnecessarily heavy. Extreme end portion 25*a* of arm 25 is attached to a flexible arm band 43 that is split longitudinally, whereby the band may readily be wrapped about the forearm of a user. The band has sufficient circumferential dimension to extend entirely about a person's arm with edge portions 44 of the band overlapped. Band edge portions 44 may be faced with fibrous adhesive patches marketed under the tradename VELCRO, whereby the band can act as a sleeve to fully encircle the person's arm. The sleeve fits on the arm to transfer a portion of the remote tool weight from the person's wrist onto the forearm. The adhesive patches enable the band to have a tight sleeve-like fit on the person's arm, whether the arm is relatively slender or relatively large. Arm band 43 preferably has a length (parallel to arm portion 25*a*) of at least six inches.

In utilizing the tool extender 10, a person may with one hand grasp the support grip handle 28, and with the other hand the handle bar 41 and grip element 49; the arm band 43 on the person's arm balances the load and transfers some load from the person's wrist to the forearm.

The tool trigger 19 is remotely actuated by actuating means including a hook 47 engageable with the trigger, an elongated actuator rod 48 extending from the hook generally parallel to arm structure 25, and a manual grip element 49 pivotably attached to arm structure 25 near its left end. The person can simultaneously have one hand extending about handle 41 and grip element 49. By exerting squeezing force on the grip element, actuator rod 48 may be moved in a right-to-left direction to remotely operate trigger 19.

In order to prevent slippage of hook 47 off of the trigger, the actuator rod 48 is guided and supported. As shown in the drawing, the rod support means comprises an eye member 51 mounted on saddle member 29, and a second eye member 53 extending from arm structure 25.

Figure 7:
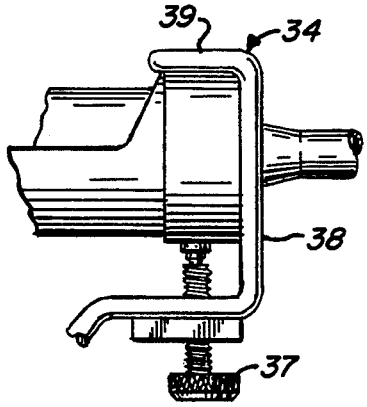
FIG. 7 is a fragmentary view taken on line 7—7 in FIG. 6.
Figure 8:
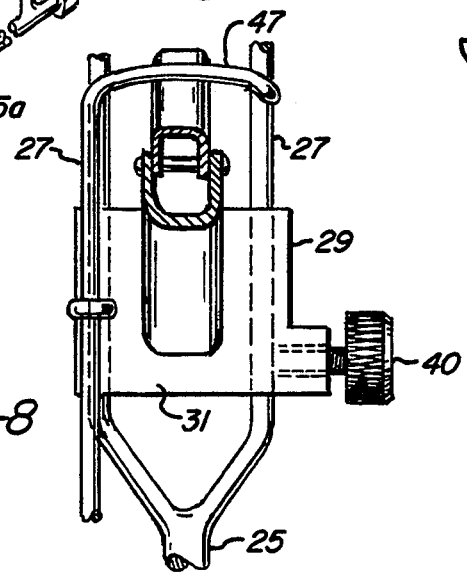
FIG. 8 is a fragmentary view taken on line 8—8 in FIG. 6.

Differently sized tools will have their triggers spaced different distances from tool nose portions 15. When the tool is supported against the cradle means 34 (.FIGS. 2 and 7), the trigger will have a different spacing from the grip element 49, depending upon the size of the tool. Therefore, it is necessary that actuator rod 48 have an adjustable length according to variations in spacing of the tool trigger from grip element 49. As shown in FIG. 5, rod 48 comprises two aligned rod sections 48*a*, 48*b* adjustably connected together via a cylindrical sleeve 48*c*. Sleeve 48*c* may have one end affixed to sleeve section 48*b*. An end portion of sleeve section 48*a* is slidably telescoped into the sleeve section 48*c* and held in an adjusted position by a set screw 60.

Thus there has been shown and described a novel tool reach extender which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventor claims:

1. A tool reach extender for a portable tool having a body with a front nose portion, a pistol grip handle and a trigger associated with the handle, said tool reach extender comprising:

cradle means engageable with the tool body front nose portion, a guide structure rigidly attached to said cradle means and extending from the cradle means for positioning under the tool body, a saddle member reciprocally slidable on the guide structure and adjustable toward or away from the cradle means, said saddle member having a recessed socket surface engageable with a bottom end surface of the tool handle, whereby the saddle member and cradle means jointly support the tool, an elongated arm structure extending from said guide structure, manual handle means on said arm structure remote from said guide structure, trigger-actuation means extending along the arm structure and having a hook engageable with the tool trigger, and a manual grip element proximate to said handle means, said trigger-actuation means being operable by manual squeezing of said grip element toward said handle means and away from said hook.

2. The tool reach extender of claim 1, wherein:

said guide structure comprises two parallel guide rods, and said saddle member has two spaced parallel guide holes extending therethrough for slidably supporting the saddle member on the guide rods.

3. The tool reach extender of claim 2, wherein:

said cradle means comprises two spaced parallel abutment bars extending upwardly from said guide rods to engage the tool body nose portion, and further including a bridge bar connecting the abutment bars, and manual screw type clamp means supported by the guide rods in proximity to the abutment bars, said clamp means comprising a clamp screw having a rotational axis parallel to the abutment bars, whereby the tool body nose is clamped between the bridge bar and the clamp screw.

4. The tool reach extender of claim 3, wherein said bridge bar is of U-shaped configuration as viewed in a direction parallel to the abutment bars.

5. The tool reach extender of claim 4, wherein:

said abutment bars and bridge bar are integral with said guide rods, and said bars and said guide rod are formed of a single elongated rod bent at spaced points therealong to form the abutment bars and bridge bar.

6. The tool reach extender of claim 1, wherein:

said guide structure comprises two parallel guide rods, said saddle member has two spaced parallel guide holes extending therethrough for slidably supporting the saddle member on the guide rods, said saddle member has an upwardly facing surface, and said socket surface is defined by a depression in said upwardly facing surface configured to mate with the heel portion of a pistol grip handle on the tool body.

7. The tool reach extender of claim 6, and further comprising:

a set screw mounted on the saddle member to grip one of the guide rods, whereby the saddle member is retained in a selected position of adjustment.

8. The tool reach extender of claim 1, wherein:

said trigger actuating means comprises an elongated actuator rod extending between said hook and said manual grip element to be generally parallel to said elongated arm structure, and further including means for slidably supporting said actuator rod so that said hook is prevented from slipping off of the tool trigger.

9. The tool reach extender of claim 8, wherein said slidable support means comprises an eye member mounted on said saddle member.

10. The tool reach extender of claim 8, wherein:

said actuator rod comprises two rod sections adjustably connected together, whereby the total length of the actuator rod is adjustable in accordance with variations in spacing of the tool trigger from the manual grip element.

11. The tool reach extender of claim 1 and further comprising:

a support handle on the elongated arm structure for manual grasping and support by a person with one hand while grasping the trigger actuation means with the other hand.

12. The tool reach extender of claim 1, and further comprising:

arm band means attached to said arm structure in proximity to said manual handle means, said arm band means comprising a flexible split sleeve adapted to be wrapped about the forearm of a user, whereby a portion of the weight of the tool is transferred from the person's wrist to the person's forearm.

13. The tool reach extender of claim 12, wherein said flexible sleeve has a length of at least six inches.

14. The tool reach extender of claim 1, wherein said guide structure has sufficient length to permit at least a six inch adjustment of the saddle member, whereby the extender can be attached to a range of differently dimensioned tools.

15. The tool reach extender of claim 1, wherein the saddle member and cradle means are constructed to fit either a caulking gun tool or a power drill tool.

* * * * *